US005570563A

United States Patent [19]

Focke et al.

[11] Patent Number: 5,570,563

[45] Date of Patent: Nov. 5, 1996

[54] APPARATUS FOR THE FOLDING OF FOLDING TABS OF A PACK AND FOR THE TRANSPORT OF THE SAME

[75] Inventors: Heinz Focke; Oskar Balmer, both of Verden, Germany

[73] Assignee: Focke & Co. (GmbH & Co.), Verden, Germany

[21] Appl. No.: 429,124

[22] Filed: Apr. 26, 1995

[30] Foreign Application Priority Data

May 17, 1994 [DE] Germany ..... 44 17 258.3

[51] Int. Cl.[6] ..... B65B 7/00

[52] U.S. Cl. ..... 53/370.5; 53/372.5

[58] Field of Search ..... 53/370.2, 370.6, 53/372.4, 372.5, 371.7; 493/180, 182, 183, 162, 72, 81

[56] References Cited

U.S. PATENT DOCUMENTS

| | | | |
|---|---|---|---|
| 2,410,587 | 11/1946 | Monroe | 53/370.2 |
| 3,078,633 | 2/1963 | Stromberg et al. | 53/370.6 |
| 3,722,175 | 3/1973 | Maulini et al. | 53/209 |
| 5,152,124 | 10/1992 | Ishii et al. | 53/370.6 |

FOREIGN PATENT DOCUMENTS

| | | | |
|---|---|---|---|
| 1096822 | 1/1961 | Germany . | |
| 1586015 | 5/1970 | Germany . | |
| 2034748 | 3/1971 | Germany . | |
| 2613277 | 10/1977 | Germany . | |
| 2814827 | 10/1979 | Germany . | |
| 4200854 | 1/1992 | Germany | 53/372.5 |
| 1209709 | 10/1970 | Switzerland | 53/370.2 |

*Primary Examiner*—John Sipos
*Assistant Examiner*—Gene L. Kim
*Attorney, Agent, or Firm*—Sughrue, Mion, Zinn, Macpeak & Seas

[57] ABSTRACT

Soft packs, especially for stacks of paper tissues, may be provided with a closing tab extending over an end wall up to a front wall. This closing tab may be attached to neighboring regions of the wrapping by gussets. Folding members, specifically folding devices (57), which are designed in a special manner, serve for folding in the region of a folding station (34). These folding devices (57) fold the closing tab into an upright position thereby folding in the gussets, during the transport of the packs. A downstream folding tool, specifically a covering-tab folder (83), then folds a covering tab as a part of the closing tab against the front wall.

9 Claims, 14 Drawing Sheets

APPARATUS FOR THE FOLDING OF FOLDING TABS OF A PACK AND FOR THE TRANSPORT OF THE SAME

BACKGROUND OF THE INVENTION

The invention relates to an apparatus for the folding of folding tabs, especially a closing tab of a pack made from foldable material as paper or foil, against a pack surface, wherein the closing tab is connected to side walls of the pack via lateral (triangular) gussets, and the gussets can be folded in between the pack surface and the closing tab when folding the latter.

SUMMARY OF THE INVENTION

The topic of the invention is the handling of cornered, especially cuboid packs of all kinds during the final phase of the production, and the subsequent continued conveyance. In particular, the invention relates to the finishing of packs with folding or closing tabs designed in a special manner. These folding or closing tabs are connected to adjoining walls of the pack via gussets designed with a triangular or other shape (DE 43 29 368). The gussets are brought into a double-layer position when finishing the pack, namely between the folding tab or closing tab, on the one hand, and an adjoining pack surface, on the other. The apparatus is particularly suitable for ready folding and handling soft packs made from thin foil, for wrapping stacks of paper tissues.

The invention is based on the object to propose an apparatus for ready-folding and further handling packs, especially soft packs of the aforementioned kind, such that the folding of the closing tabs including the gussets takes place accurately and within a relatively shorter time.

To attain this object, the apparatus according to the invention is characterized by folding members, which are moveable in planes parallel to the pack surface and relative to one another, whose folding fingers fold the gussets along a diagonal folding line relative to fixed supporting legs into the position between the supporting legs and the pack surface, thereby erecting the closing tab from a starting position transverse relative to the pack surface (end surface) into a position parallel thereto.

In the apparatus according to the invention, the folding of the folding tab as a part of the closing tab, together with the folding in of the gussets is effectuated by means of a common folding member or folding device, which is transported synchronously with the packs along the path of movement thereof. As a result, an accurate folding within a relatively short distance of transport is possible.

The folding device comprises, according to the invention, two folding tools, specifically (two) stationary folding webs with a diverging folding edge, and (two) folding fingers which can be spread apart. As a result of the downward movement of the folding device with the folding webs, and a coordinated transverse spreading movement of the folding fingers, the folding tab or the complete closing tab is erected in one folding cycle, and the gussets are moved into the position appropriate for the pack.

According to the invention, in the region of a folding station, the packs are transported together with the above-described folding devices by a special pack conveyor. The pack conveyor is provided with retaining webs arranged in pairs for forming a reception or pocket for a pack, at least one of the retaining webs being movable from a closing position during the reception or discharge of a pack, into a retaining position, thereby contacting the pack.

Furthermore, the apparatus according to the invention is provided with a folding device for folding over an upright projecting portion of the closing tab, specifically a covering tab. The folding device is provided with rotationally driven folding cylinders having a reference-cylinder surface, axis parallel extending edges taking effect as folding edge.

Finally, a turning station is a part of the apparatus according to the invention. In the region of the turning station, packs of a pack row—in a two-track method of operation—are rotated about 180°, so that the packs of the two pack rows are arranged in a same attitude.

Further features of the invention are the subject matter of the subclaims.

BRIEF DESCRIPTION OF THE DRAWINGS

Exemplary embodiments of the invention are explained hereinafter with reference to the drawings. In these.

Figure 1:
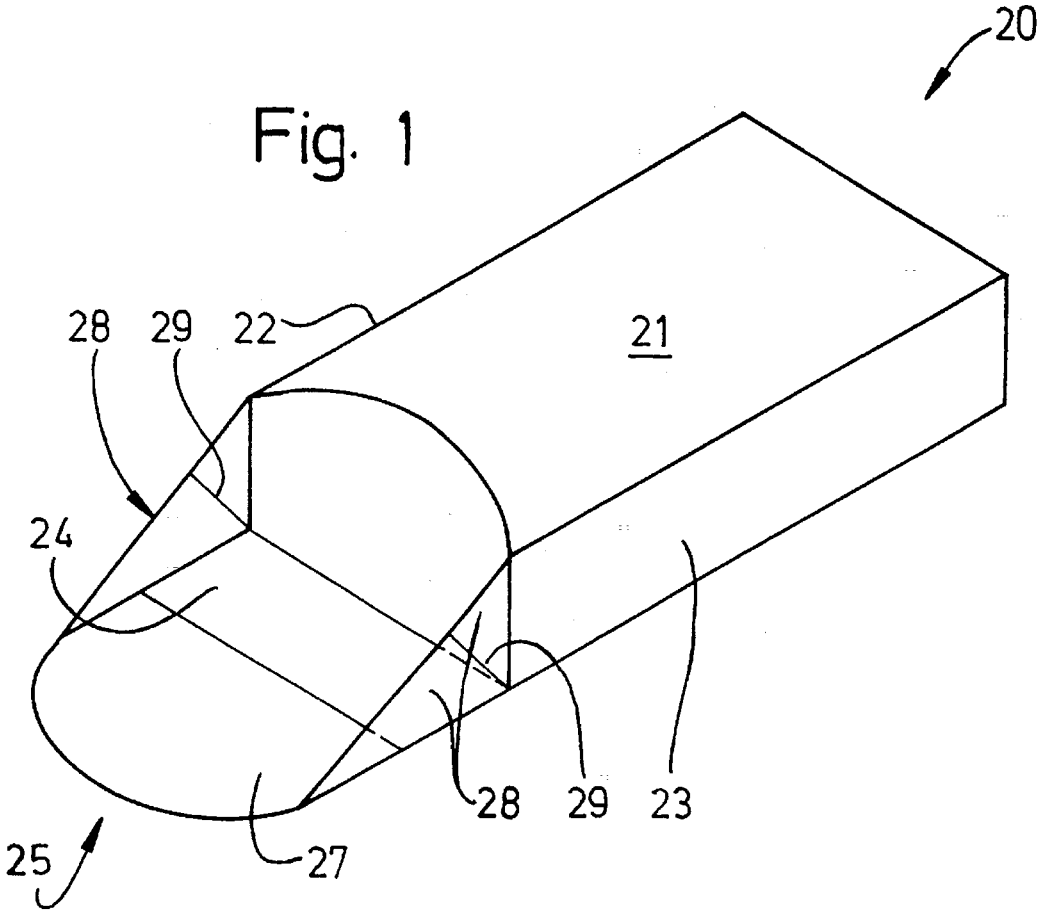
FIG. 1 shows an opened (soft) pack in a perspective view.
Figure 2:
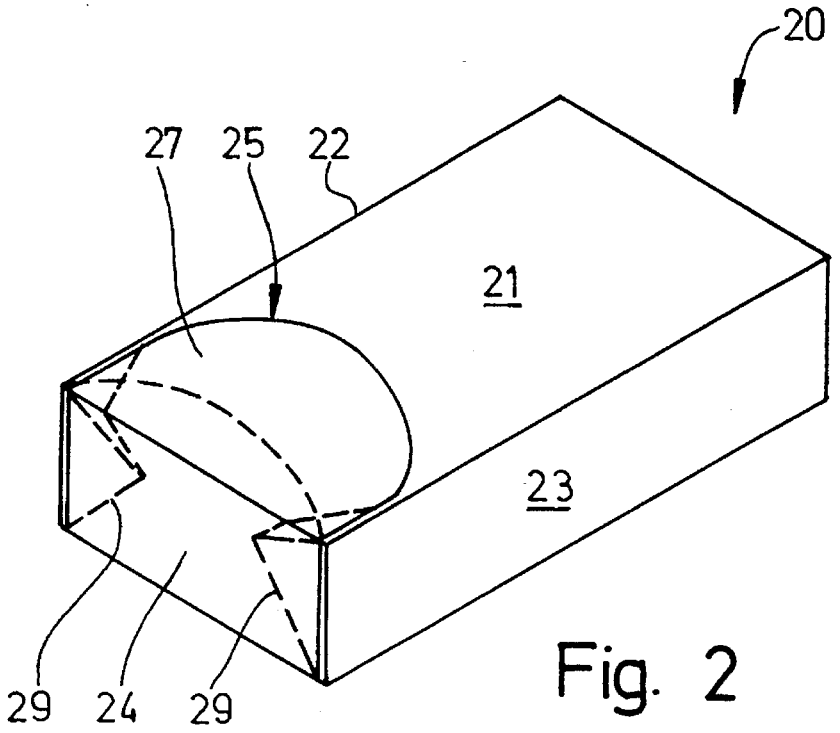
FIG. 2 shows the pack according to FIG. 1 in a closing position, also a perspective view.

The shown apparatus can be employed for handling packs of different kinds. The processing of (soft) packs 20, as shown in FIGS. 1 and 2, is particularly expedient. The pack is preferably a foil or paper pack 20 for a stack of folded paper tissues (not shown).

The packs 20 form a front wall 21, two narrow, longitudinal side walls 22 and 23, and an end wall 24. An opening of the pack 20 is located in the region of the end wall 24. This opening can be closed by a closing tab 25 (FIG. 2). The folding tab 25 is comprised of an end wall 24, and an adjoining covering tab 27. The covering tab 27 adjoins the front wall when the pack 20 (FIG. 2) is closed, and is connected thereto by means of releasable adhesive bonding.

The closing tab 25 is connected to an upper transverse edge of the side walls 22, 23, and thus to the side walls of the pack 20, by means of triangular gussets 28. The gussets 28 are folded inwardly when closing the pack 20 and rest in the region between closing tab 25 and end wall 24 and—in the case of a corresponding dimension—front wall 21. In the folding process, the gussets 28 are folded from the position according to FIG. 1 into the position according to FIG. 2 in the region of the diagonal folding line 29. At the same time, a folding is carried out in the region of the connection of the gussets 28 with the closing tab 25, on the one hand, and the sidewalls 22, 23, on the other. Triangular portions of the gussets 28 are folded against one another so that they partially overlap. The gussets 28 are entirely overlapped by the closing tabs 25 in the closed pack (DE 43 29 368).

Figure 3:
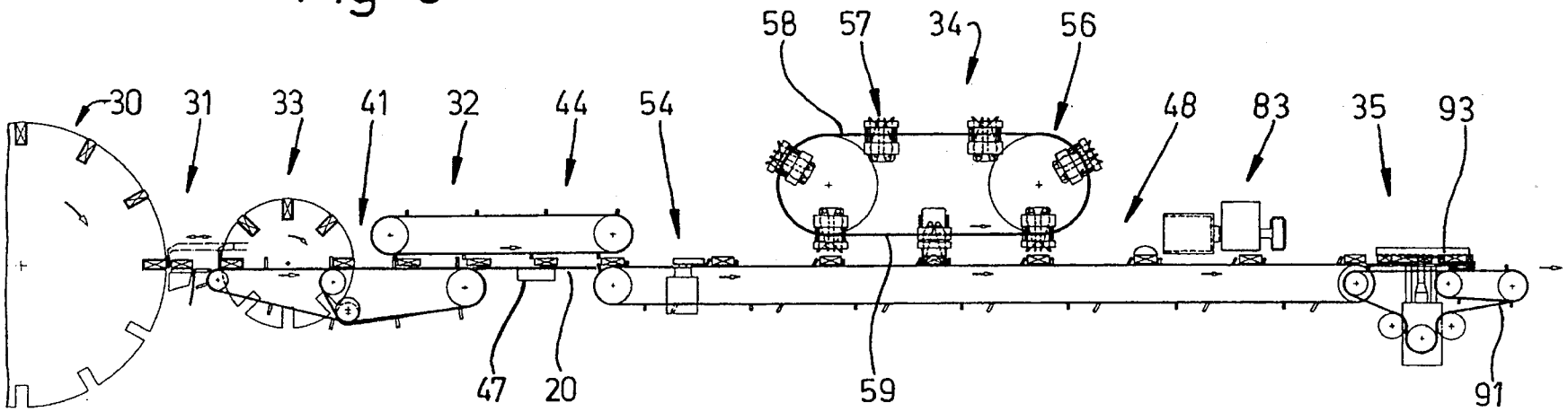
FIG. 3 shows an apparatus for handling, especially folding, packs according to FIGS. 1 and 2 in a diagrammatic total view, namely a side view.

These or similar packs 20 are almost ready-folded in the region of a folding turret 30 in the apparatus according to FIG. 3. The folding turret may correspond to the one according to U.S. Pat. No. 4,845,925. In the region of the pushing-out station 31, the almost finished packs 20 which essentially correspond to the shape according to FIG. 1 are pushed out of the folding turret 30, and transferred to a straight pack track 32. In the region thereof, different measures are applied to the packs 20.

A turning device, in particular a turning turret 33, is provided immediately downstream of the folding turret 30. In the region of the turning turret 33, the packs 20 are turned in pockets of the turning turret along a conveying track of 180°, so that the front wall facing downwards when leaving the folding turret faces upwards. The packs 20 are in the position according to FIG. 1 afterwards. This turning operation is necessary especially if the apparatus operates in a double-track mode and thus if, in the region of the folding turret 30, two packs 20 are manufactured simultaneously next to one another, the packs 20 of one of the pack rows having to be turned in said direction.

The packs 20 are then fed to a folding station 34. In the region thereof, the closing tab 25 is folded into a closing position first, namely into an upright position. Then the covering tab 27 is folded against the front wall 21.

Figure 14:
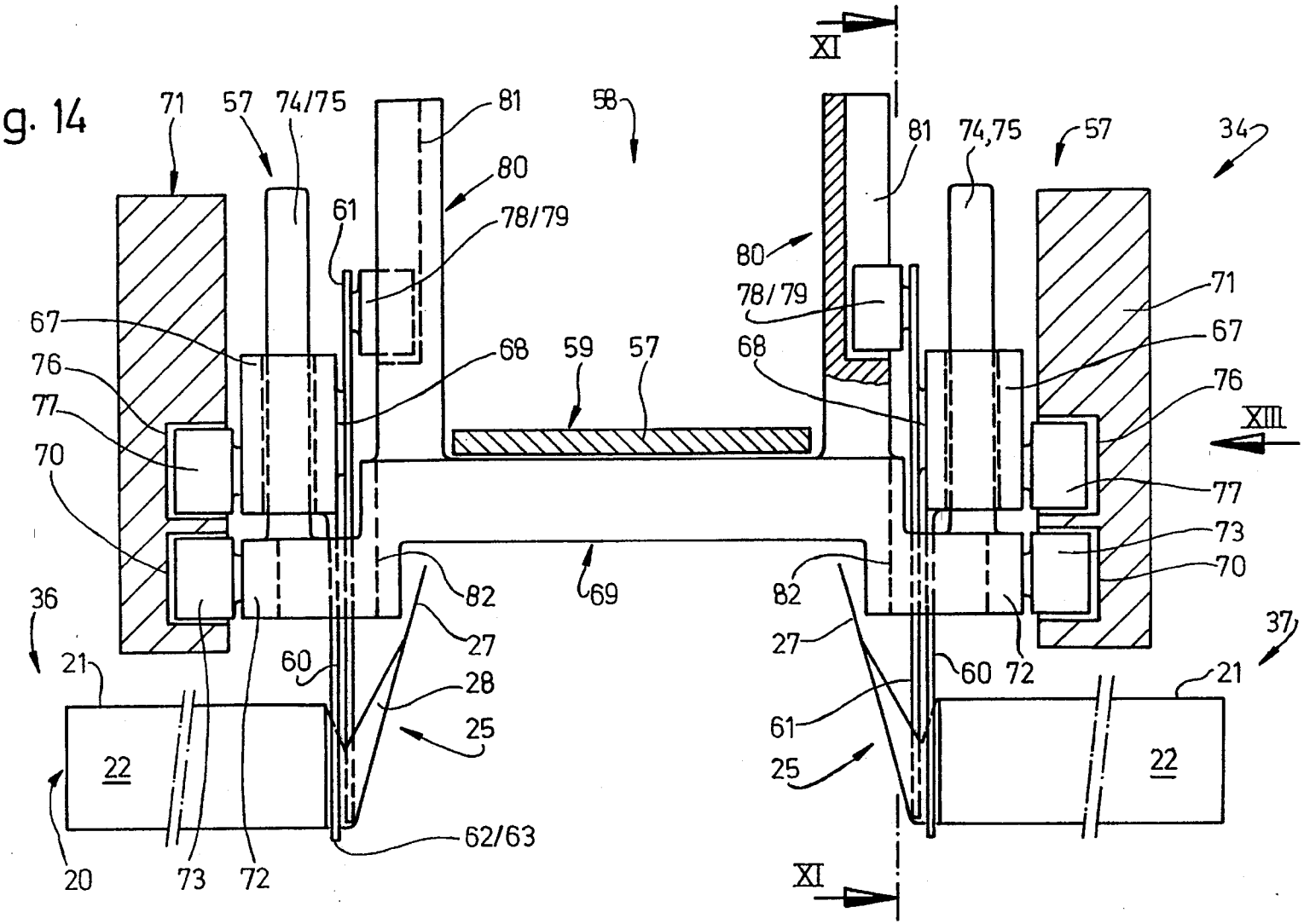
FIG. 14 shows a folding device for a double-track method of operation in cross-section or in a transverse view of the folding station.
Figure 15:
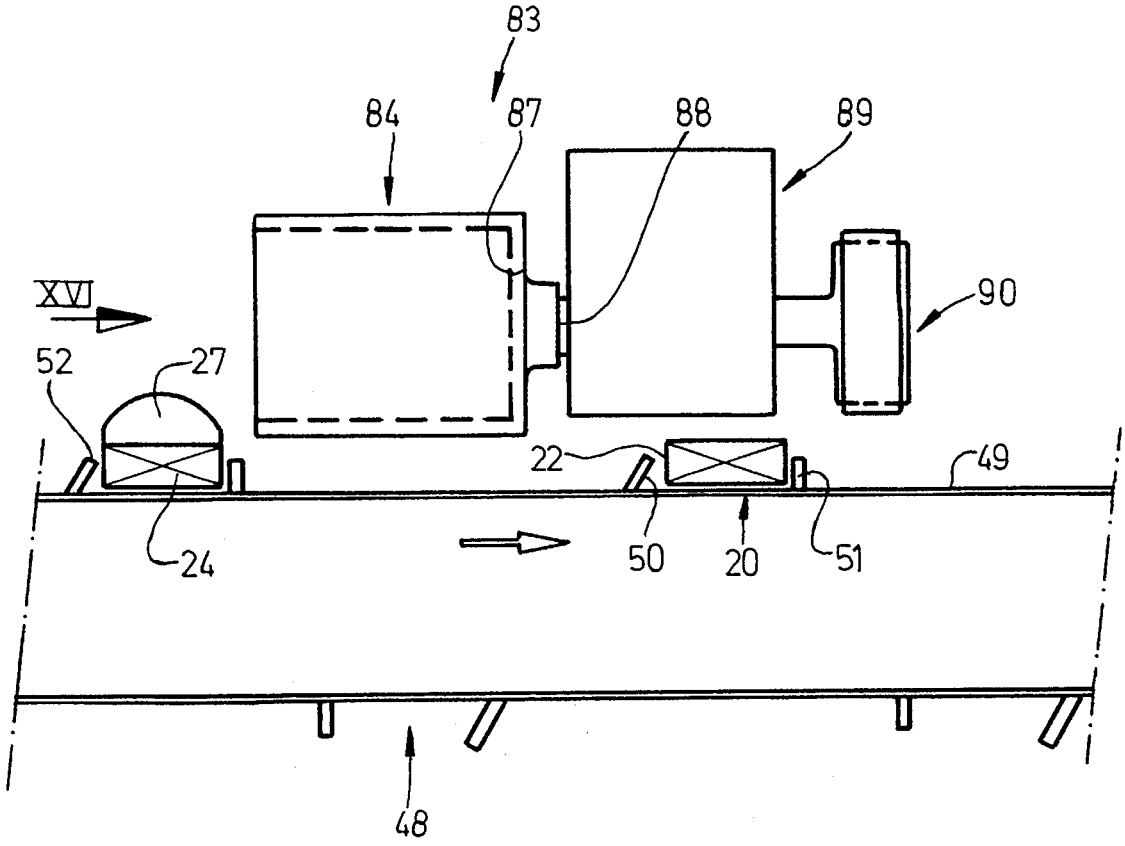
FIG. 15 shows a detail of a further folding member for folding over a covering tab, in a side view.

Downstream thereof, the packs 20 reach the region of the turning station 35. This turning station as well is important especially in a double-track manufacturing process. The packs 20 of the two packs rows 36, 37 face one another with the end walls 24 or the closing tabs 25 (FIG. 14). In the region of the turning station 35, the packs of the one pack row 36 or 37 are rotated about 180° in a horizontal plane so that thereafter the packs 20 of both pack rows 36, 37 are arranged in the same attitude.

In the region of the pushing out station 31, the packs 20 are placed onto a platform 38 after exiting from the folding turret 30. From this platform 38, the packs 20 are transferred either to a belt conveyor 41, or to the turning turret 33 via a stationary bridge 40 by a slide which is movable to and fro. In a double-track method of operation, one pack row can be transferred to the belt conveyor 41, and the other, for carrying out the rotating movement, to the turning turret 33. The packs 20 transported by the turning turret 33, after a movement of 180°, are transferred to a connecting conveyor 42 which is designed in a similar manner as the belt conveyor 41, in particular with transversely projecting carriers 43 for grasping the transversely lying packs 20 in the region of the side wall 22. The connecting conveyor 42 and the belt conveyor 41 extend parallel to one another downstream of the turning turret 33, for the transport of one pack row 36, 37 each.

The packs 20 are transferred to the belt conveyor 41 or from the connecting conveyor 42 to an intermediate conveyor 44. This intermediate conveyor is also designed as a conveyor belt having carriers 45 for grasping the packs 20 at the rear side. The intermediate conveyor 44 is arranged above the path of movement of the packs 20. These are slideably transported on a stationary, table-like base 46.

In the region of the intermediate conveyor 44 or the base 46 possibly faulty packs 20 are sorted out. These faulty packs are identified in the folding turret 30 or afterwards by appropriate inspecting means and, in the region of the base 46, conveyed into a container 47 through an opening in the base. The intact packs 20 are moved over the opening or the container 47.

The intermediate conveyor 44 transfers the packs 20 to the folding station 34. In the region thereof, the packs 20 are transported by means of a pack conveyor 48 which is designed in a special manner. This pack conveyor 48 is designed as a belt conveyor and one or two conveyor belts 49 may be assigned to each pack row 36, 37, as a pack conveyor 48. The conveyor belts 49 are provided with transversely projecting retaining rods 50, 51. Two respective retaining rods 50, 51 are arranged at such a distance from one another that they form a reception or pocket for the pack 20.

Figure 4:
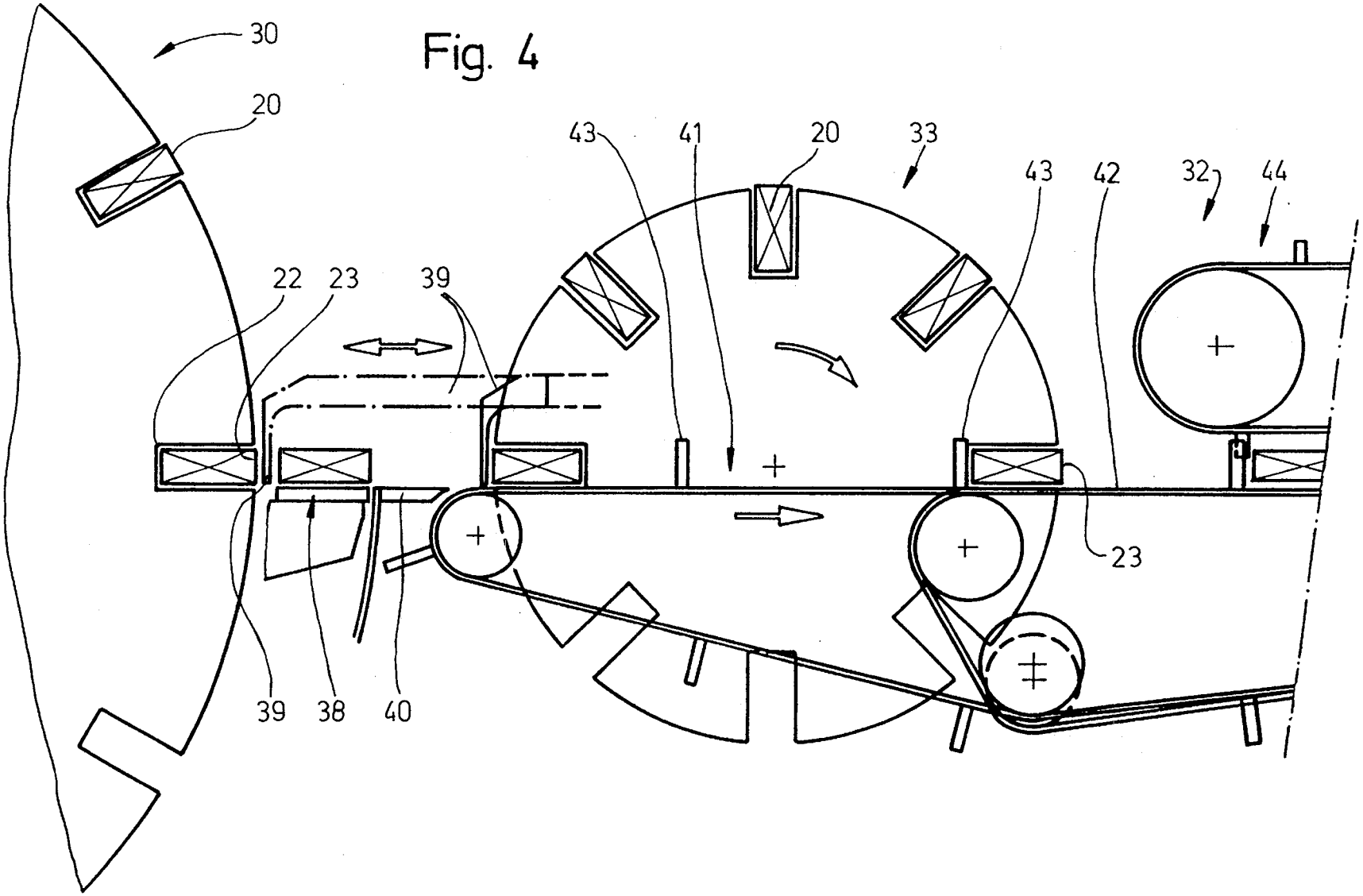
FIG. 4 shows a portion of the apparatus according to FIG. 3, on an enlarged scale.
Figure 5:
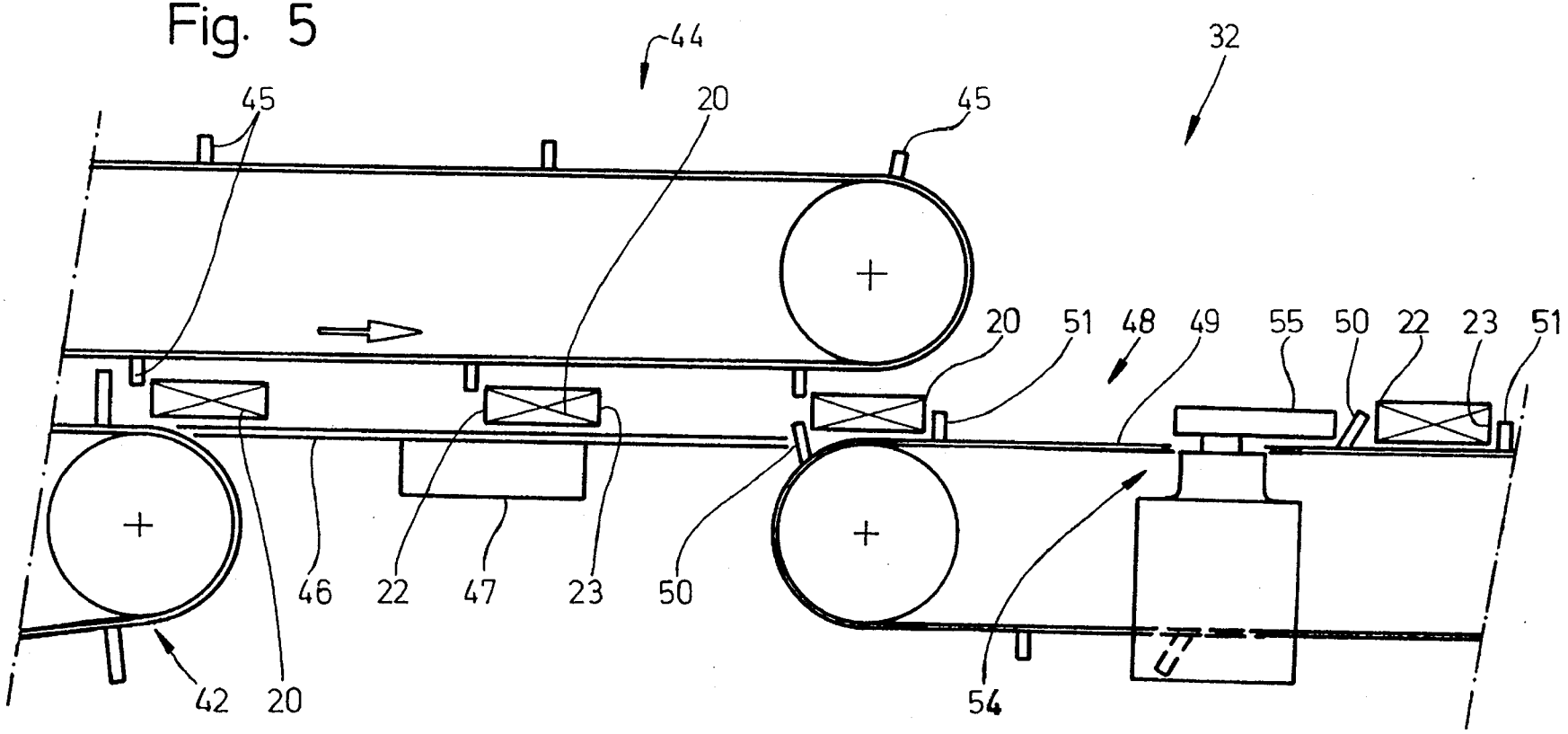
FIG. 5 shows a further portion of the apparatus according to FIG. 3, also on an enlarged scale.
Figure 6:
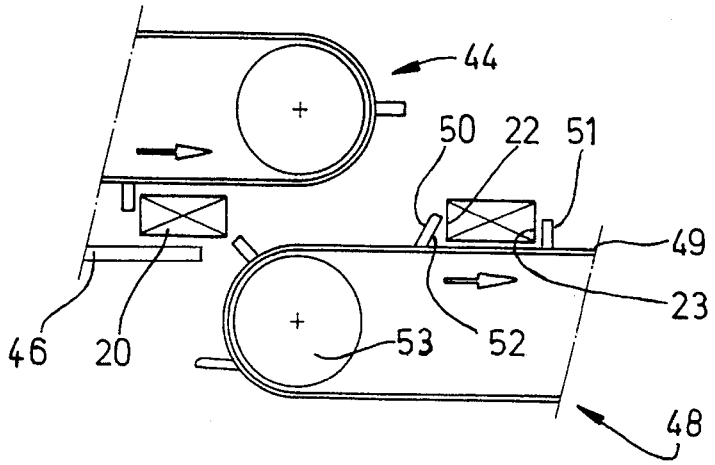
FIG. 6 to FIG. 9 show phases of motion during the transfer of a pack to a pack conveyor which is designed in a special manner.
Figure 7:
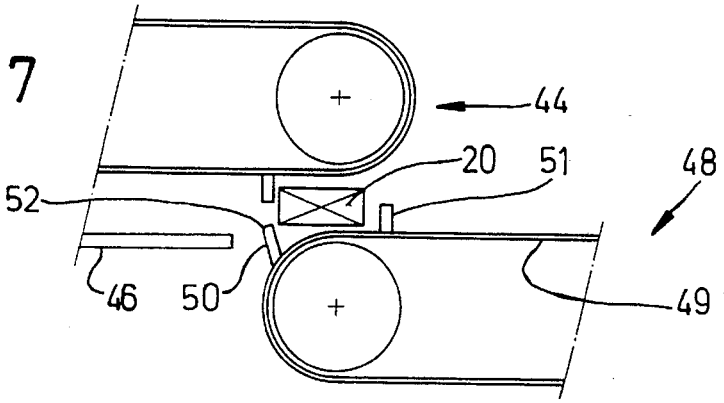
Figure 8:
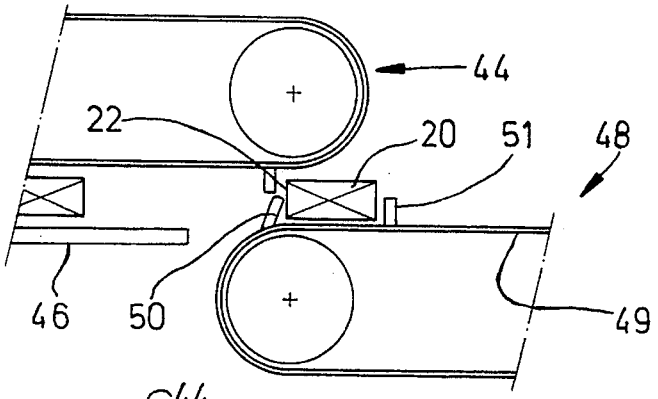
Figure 9:
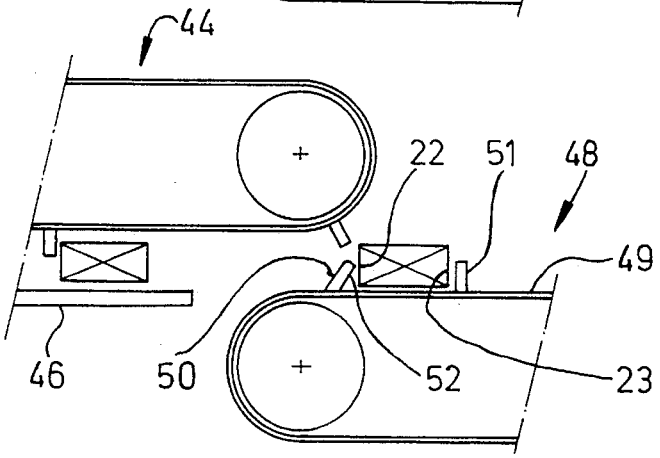

The receptions or pockets are designed in such a manner that the packs 20 are frictionally retained in the region of the folding station 34. To this end, at least one of the retaining rods 50, 51 is movable in order to exert a retaining or clamping force on the side walls 22, 23 of the pack. In the present exemplary embodiment, one of the retaining rods, in particular the retaining rod 51, which is forward in the direction of transport, is directed upwards or at a right angle relative to the conveyor belt 49. The other rearward retaining rod 50 is directed towards the plane of the conveyor belt 49 at an acute angle such that an outer free edge 52 adjoins the opposing sidewall 22 under tension. When the pack 20 is transferred to the pack conveyor 48 in the region of a deflection of the conveyor belt 49, in the present case in the region of a deflecting roll 53, the retaining rod 50 is temporarily moved into an opening position due to the geometrical relations (FIG. 4). In this position it is possible to guide the pack 20 into the reception or pocket without any force, namely into the position between the two retaining rods 50, 51. The retaining rod 51 has thereby already left the region of the deflecting roll 53, whereas the retaining rod 50 is still present in the region of deflection thereof. During the further movement of the conveyor belt 49, the retaining rod 50 moves out of the region of the deflecting roll 53 and, as a result, under generation of a retaining force, is moved against the side wall 22 which is rearward in the conveying direction (FIGS. 8 and 9). Consequently, an automatic opening and closing of the pockets takes place as a result of the deflection of the conveyor belt 49.

The essential folding processes described above are conducted in the region of the folding station 34.

First, the partially folded packs 20 are moved past a bottom folder 54. This bottom folder 54 essentially is a rotationally driven folding thumb 55 which folds a bottom tab (not shown) which is located rearward in the conveying direction of the pack 20, as a result of the rotating movement.

The packs 20 are then conveyed into the region of a folding unit 56. The folding unit 56 folds the end regions of the pack 20.

The folding unit 56 is arranged above the pack conveyor 48 and comprises a plurality of folding devices 57, each for folding a pack 20. The folding devices 57 are arranged on an endless device conveyor 58, in particular at distances from one another which correspond to the distances of the packs 20 in the region of the pack conveyor 48. The device conveyor 58 thus guides one folding device 57 to each pack 20. The folding devices are moved parallel to the packs 20 along a conveying track by means of a lower conveying strand 59. The folding devices 57 are active during this phase and carry out the folding described in conjunction with FIGS. 1 and 2.

The respective folding device 57 which runs along above the pack 20 is temporarily lowered onto the pack 20 for this purpose, in particular in the region of folding tabs to be folded. After carrying out the folding, the folding device 57 is lifted up again and guided out of the region of the packs 20 by deflection of the device conveyor 58.

Figure 11:
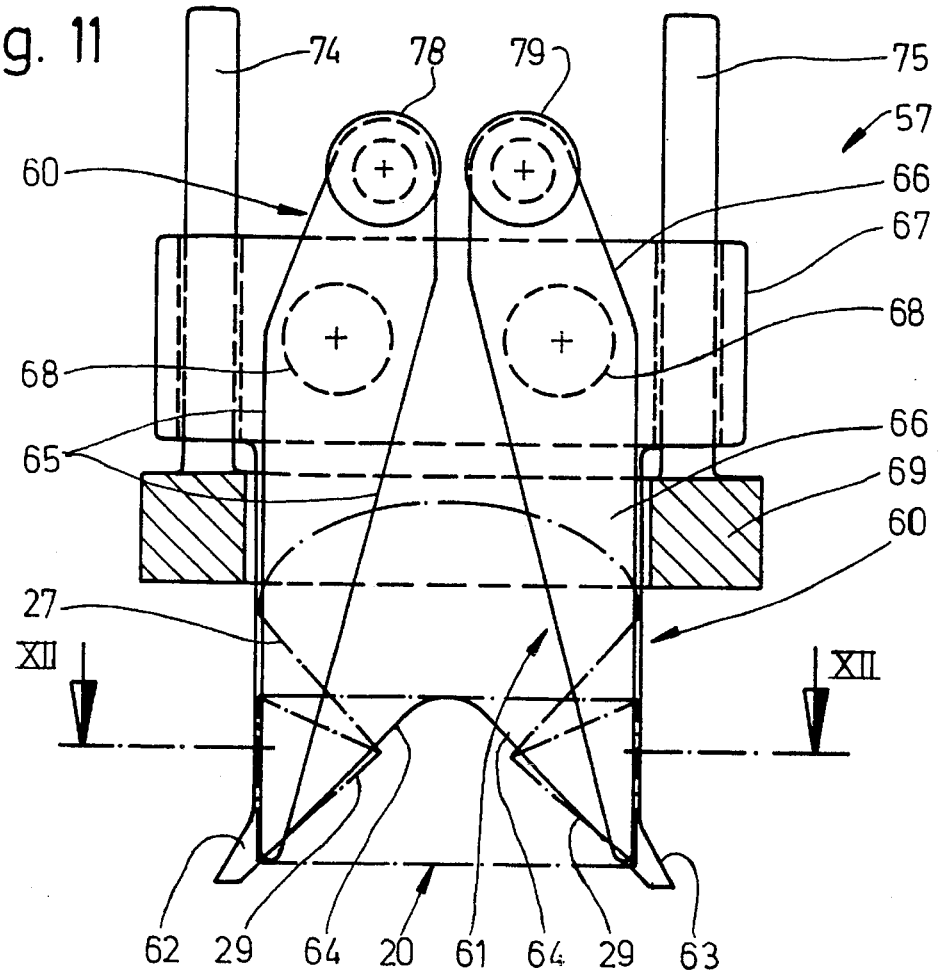
FIG. 11 shows a detail of a folding device of the apparatus according to FIG. 10, namely folding members in a view or a section taken along the plane XI—XI of FIG. 14.
Figure 12:
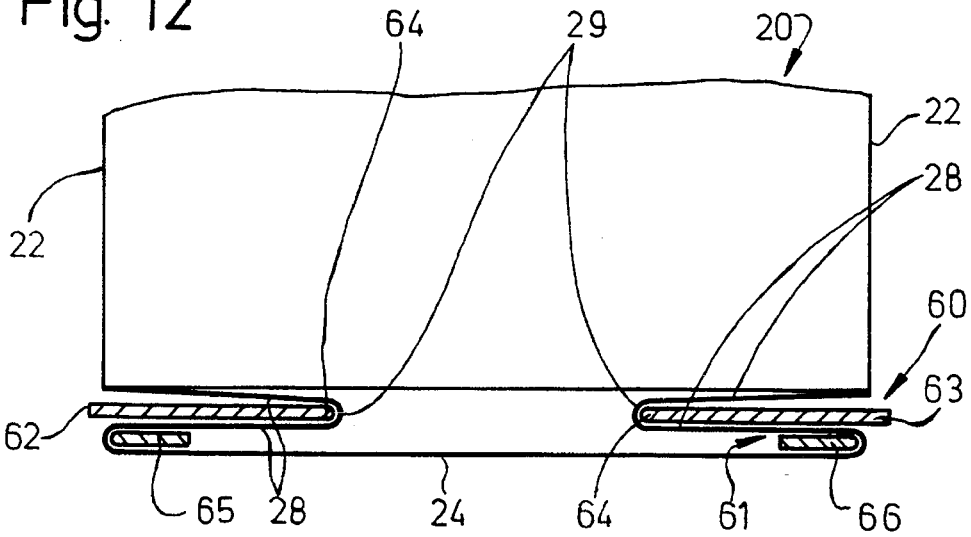
FIG. 12 shows a horizontal section in the plane XII—XII of FIG. 11.

Each folding device 57 comprises two interacting folding members 60 and 61. The folding members are movable relative to one another such that the gusset 68 is folded inwardly into a double-layer position, and thus with the gussets lying on top of one another. At the same time, the closing tab 25, and thus the end wall 24 with the covering tab 27, are folded into an upright position (FIG. 14). The two folding members 60, 61 are moved parallel to one another in two adjacent planes in this folding step (FIG. 11).

The folding member 60 can merely be moved up and down and is stationery during the folding process. It is made from a flat material in a plate-like shape with diverging supporting legs 62, 63 formed in the lower region. These are located between the part gussets of the gussets 28 during the folding process. A folding edge 64 of the supporting legs 62, 63 extends along a diagonal folding line 29.

Figure 10:
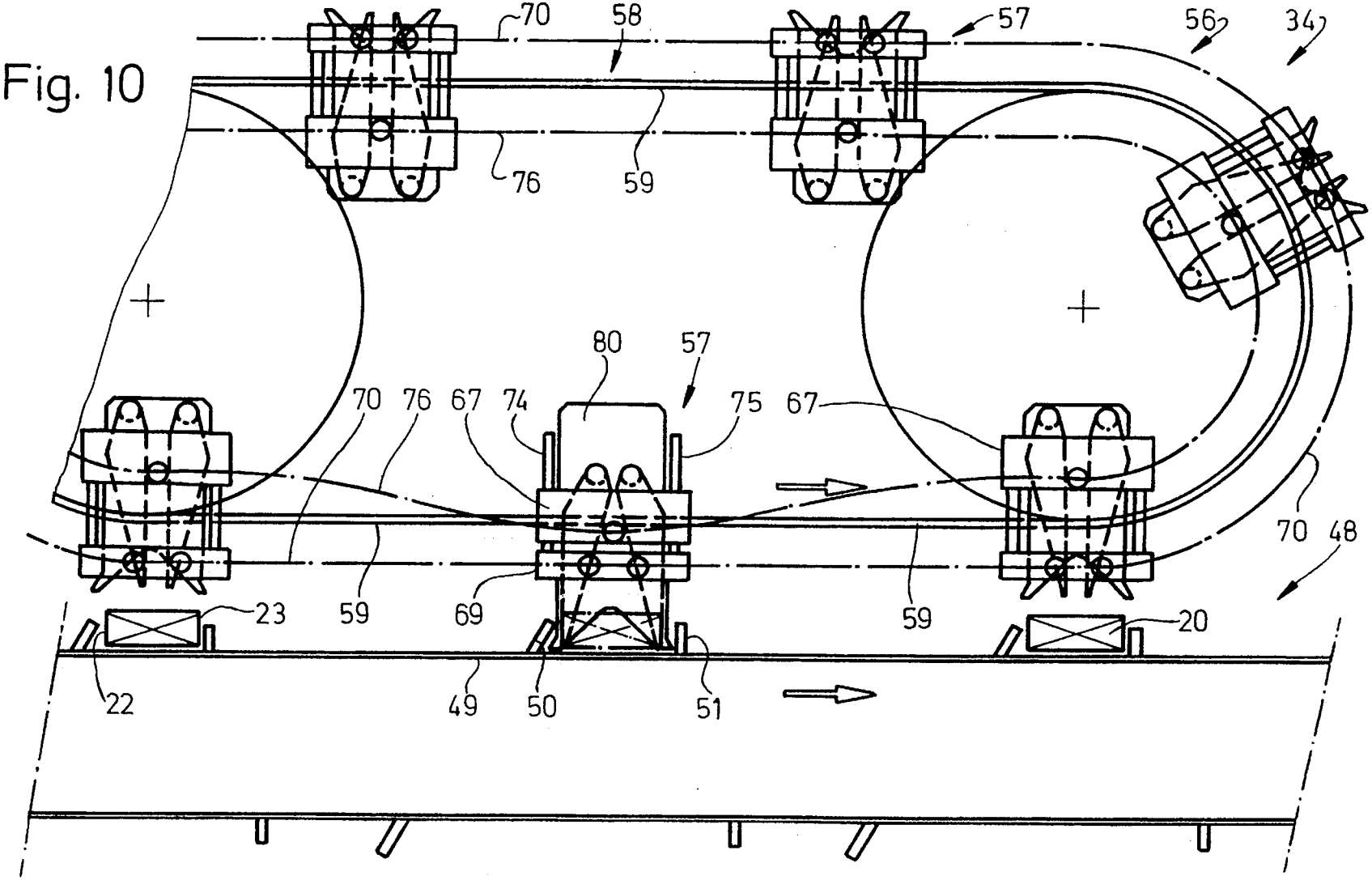
FIG. 10 shows details of a folding apparatus in the region of a folding station, in a side view.

The folding member 61 comprises two folding fingers 65, 66, which are movable relative to one another, namely pivotable. These folding fingers 65, 66 are pivotably mounted on a supporting body 67, which can be moved up and down, in the region of a rotary joint 68. These swiveling movements are controlled such that the folding fingers 65, 66 are spread apart at a small distance from one another from a starting position (FIG. 10, left hand side). This folding movement takes place relative to the stationary supporting legs 62, 63 of the folding member 60. As a result, the gusset 28 is folded around the supporting leg 62, 63. At the same time, the entire closing tab 25 is moved into an upright intermediate position.

The movement of the folding devices 57 and the folding members 60, 61 thereof are exclusively controlled mechanically via curved paths in the present exemplary embodiment. As emerges especially from FIG. 14, the folding station 34 or the entire apparatus is designed for a double-track method of operation. The two pack rows 36, 37 are moved in the region of the folding station 34 in such a manner that the regions to be folded, in particular the end faces, face towards one another. A common device conveyor 58 extending in the center is provided for the two lateral folding devices 57 of the two pack rows 36, 37. The two folding devices 57 assigned to the pack rows 36, 37 are located in a common transverse plane. The device conveyor 58, in the present case, is comprised of an endless toothed belt on whose conveying strand 59 a transversely directed crossbar 69 is arranged. The folding devices 57 are arranged on the lateral ends of the crossbar 69.

At least in the region of the folding path, the folding devices 57 are guided in horizontally extending grooves 70 of lateral walls 71 for accurate positioning. These are fixedly mounted, for example connected to the machine frame. Offset ends 72 of the crossbars 69 run with supporting rolls 73 in the two grooves 70.

The folding members 60 which are located outwardly relative to the device conveyor 58 and which are thus facing the pack 20 can merely be moved up and down. To this end, they are fixed on the supporting body 67 which can be moved up and down on guides of the crossbar 69, in the present case on two upright, upwardly directed guide rods 74, 75 which are arranged at a distance from one another and which are fixed on the ends 72 of the crossbar 69. The up and down movement of the folding members 60 or the supporting body 67 is effectuated by a further control groove 76 into which enters a control roll 77 which is connected to the supporting body 67. The groove 70 and the control groove 76 are shown in dot-dash lines in FIG. 10.

Figure 13:
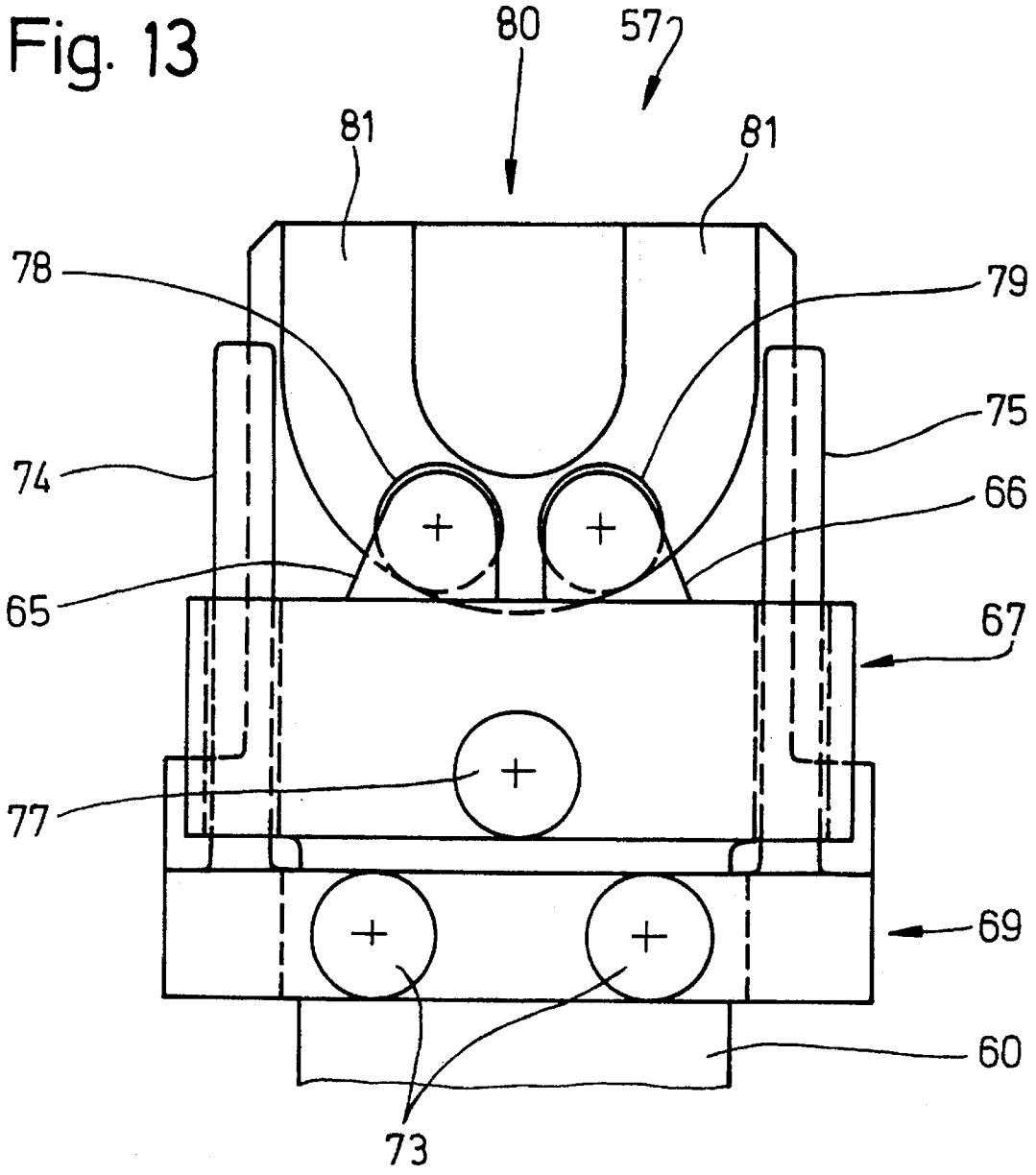
FIG. 13 shows a further detail of the folding unit of the apparatus according to FIG. 10 in a view XIII of FIG. 14.

The spreading movement of the folding fingers 65, 66 of the folding member 61 is, in the present case, also effectuated by the guide rolls 78, 79, which are each assigned to one folding finger 65, 66, which are designed with two arms. On the crossbar 69, one upright guide body 80 is arranged on each side. Upright control paths 81, which take the form of grooves, are formed in this guide body 80. Each guide roll 78, 79 runs in a upright control path 81 assigned thereto. The shape of these control paths 81 is such that during a downward movement of the folding device 57, the outwardly directed spreading movement of the lower regions of the folding fingers 65, 66 is carried out. In the present exemplary embodiment, the control path is U-shaped (FIG. 13). Each guide roll 78, 79 is assigned a leg of the U-shaped control path. As a result of the downward movement of the supporting body 67, and as a consequence of this shape of the control path 81, a pivoting movement of the two-arm folding fingers 65, 66 takes place, in particular about the rotary joints 68.

The crossbars 69 or the end 72 thereof are provided with slit-like recesses 82 for the penetration of the folding members 60, 61.

Two opposing folding devices 57 are thus synchronously conveyed and actuated by the common device conveyor 58. As emerges from FIG. 10, the supporting body 67 is lowered to a central region of the lower conveying strand 67 during further transport, in particular by a downwardly extending course of the control groove 76. The folding movements of the folding members 60, 61 are also carried out with the downward movement of the supporting body 67.

The method of operation of the folding unit 56 is such that in the region of the lower conveying strand 59, which faces the packs 20, the folding members 60, 61 can be served to the packs 20 by a downward movement of the supporting body 67. During this downward movement, the described folding movements are carried out, in particular an outwardly directed spreading movement of the folding fingers 65, 66 relative to the supporting legs 62, 63.

The folding members 60, 61 are lowered down to the lowest conveying plane of the pack conveyor 48. Thereafter, the folding members 60, 61 are moved out of the region of the packs 20 by an upward movement of the supporting body 67 (FIG. 10, right hand side). At the same time, the folding members 60, 61 return to their starting position.

Figure 16:
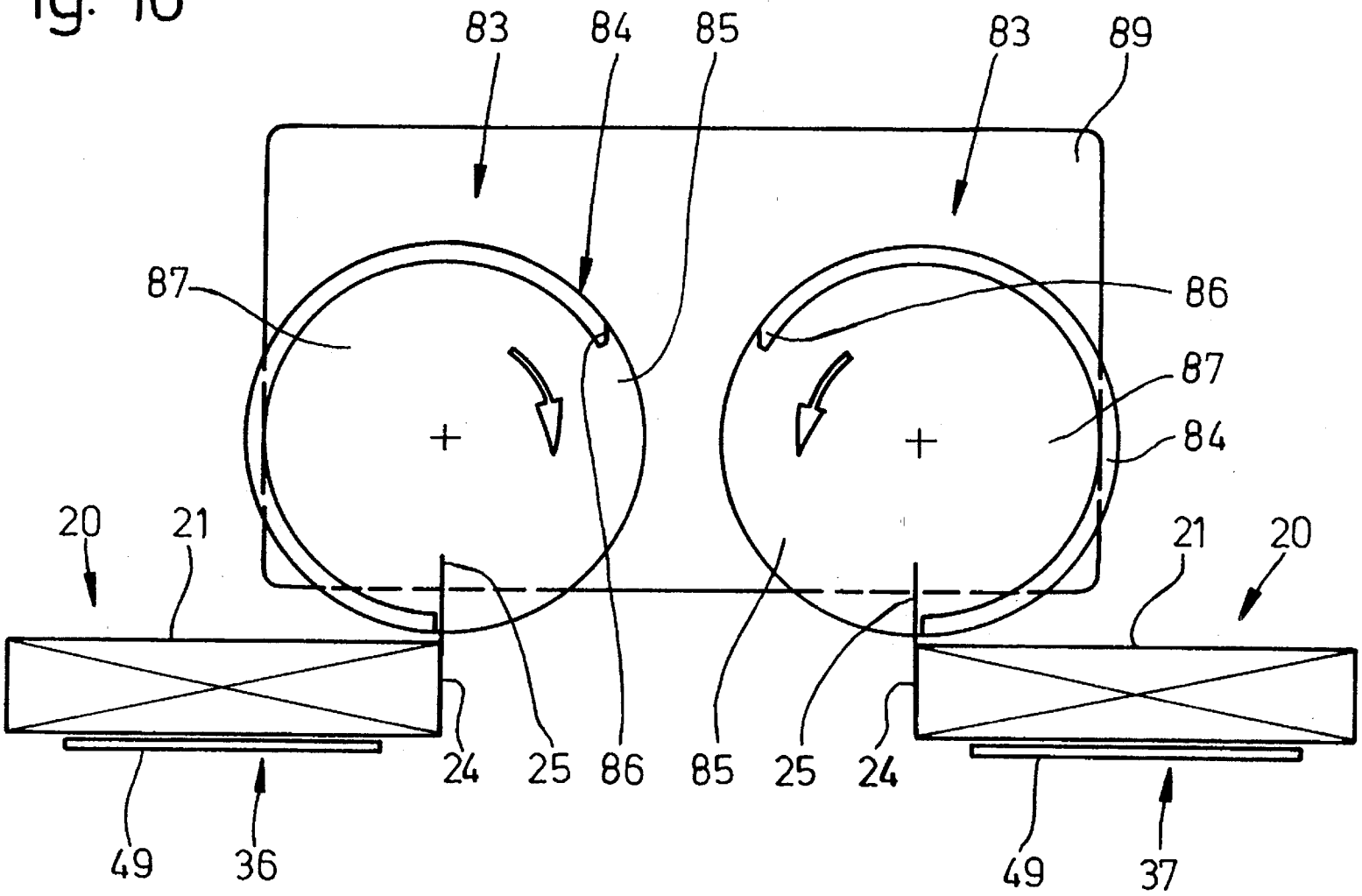
FIG. 16 shows the folding apparatus according to FIG. 15, in a transverse view.

After exiting from the folding unit 56, the packs 20 assume an intermediate folding position in the end region according to FIG. 16 with erected closing tabs 25. To complete the folding, a further folding tool for each pack follows the folding unit 56, specifically a covering-tab folder 83. Above the path of movement of the packs 20, one such covering-tab folder 83 is provided for each pack row 36, 37.

The covering tab folder 83, in the present case, is comprised of a partially cylindrical folding means, specifically a folding cylinder 84. This is a partially cylindrical structure with an open region 85 which, on one side, limits a beveled folding edge 86 of the folding cylinder 84. The folding cylinder 84 is open at an axial end and provided with a transversely directed end wall 87 on the other end. On this end wall 87 is arranged a central pivot bearing 88, for the one-sided mounting of the covering tab 83.

Two respective covering-tab folders 83 in the described embodiment are mounted on one common transmission housing 89. This transmission housing transmits the drive of a belt drive 90 to the two folding cylinders 84, so that they are rotated about a longitudinal axis in coordination with the relative movement of the packs 20 transported by the pack conveyor 48. This longitudinal axis of the folding cylinder 84 extends in the conveying direction of the packs 20. The folding edge thus also extends in the conveying direction.

The mutual coordination of movements is such that the arriving packs 20 with the erected covering tabs 27 move into the folding cylinder 84 in the open region thereof (FIG. 16). Each folding cylinder 84 is rotated such that during the further movement of the pack 20, the folding edge 86 is moved against the covering tab 27 from the free side. The covering tab 27 is folded over against the front wall 21 of the pack 20 by the folding edge 86 (FIG. 2). The cylindrical outer contour of the covering-tab folder 83, specifically the folding cylinder 84, causes the covering tab 27 to remain fixed in the closing position even when the packs 20 are moved further, and also when the rotary movement of the folding cylinder is continued. This closing position is maintained in an appropriate manner, e.g. by a tape, after leaving the covering tab folder 83.

The now ready-folded packs 20, in the shown exemplary embodiment, are moved into the region of a turning station 35. The purpose of this turning station 35 is to turn the packs 20 of at least one pack row 36, 37 about 180° so that the end sides (end faces 24) are arranged in a same attitude in a two-track method of operation.

The turning station 35 is arranged at the end of the pack conveyor 48, in a region between this conveyor and a discharge conveyor 91. The turning station 35 is merely arranged in the region of one conveyor belt 49 of the pack conveyor 48 which comprises two parallel conveyor belts 49 in a two-track method of operation.

In the present case, the turning station 35 consists of a slide plate 92 on which the packs 20 are slideably conveyed during the turning process. The sliding plate 92 extends at the level of the path of movement of the arriving and discharged packs 20.

On the sliding plate 92, the packs 20 are moved by means of a turning member 93. This turning member 93 is designed plate-shaped and mounted centrally on a rotationally driven shaft journal 94. The turning member 93 has a plurality of transversely protruding, in the present exemplary embodiment four, carrier fingers 95. These are positioned such that they laterally, specifically on the end face, or opposite thereof, on the bottom, grasp a pack supplied by the pack conveyor 48 when it hits the sliding plate 92.

Figure 17:
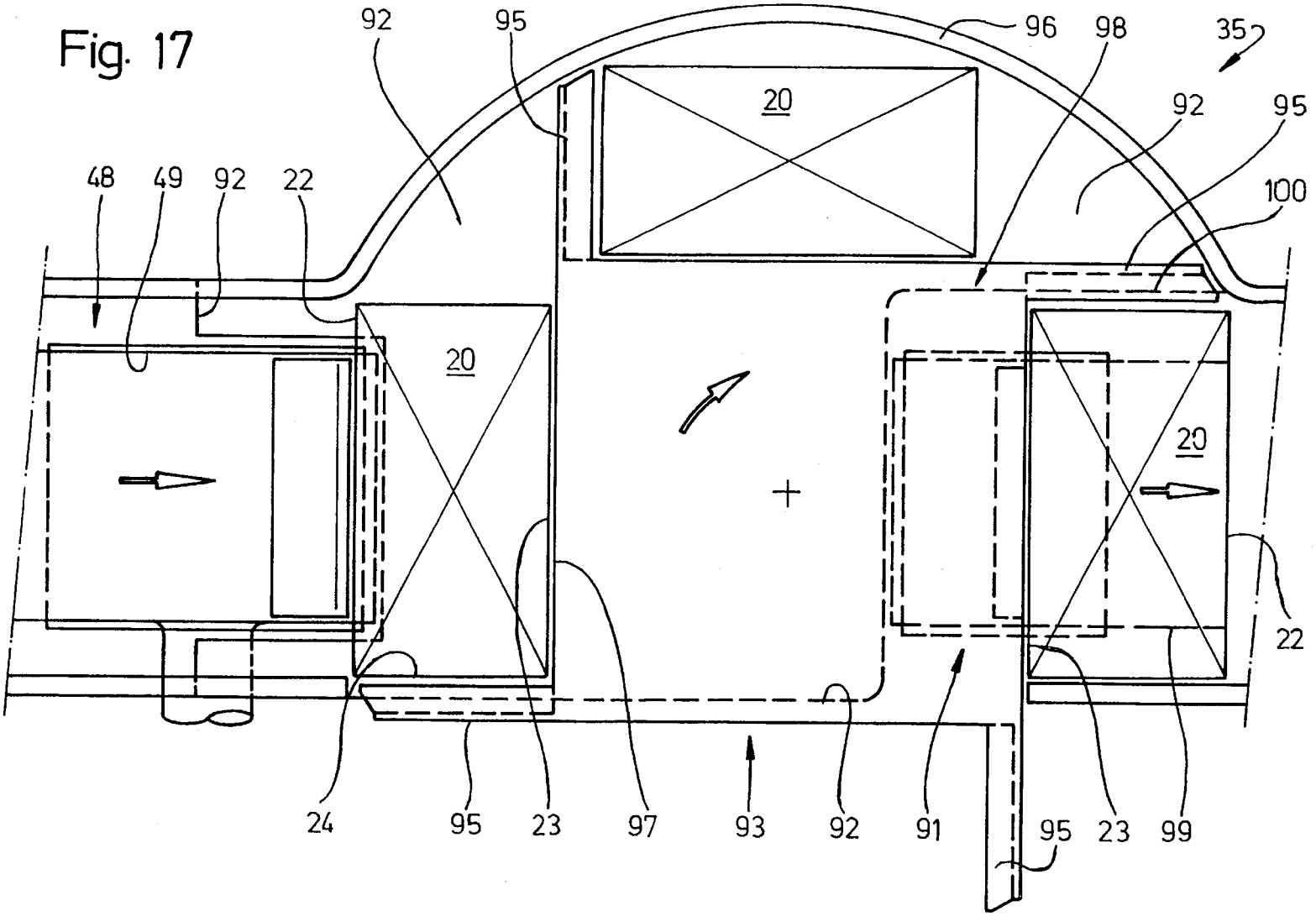
FIG. 17 shows details of a ground plan of a turning station for packs, on an enlarged scale.

The pack 20 is now moved along on the sliding plate 62 by the carrier finger 95 from the position according to FIG. 17, the regions located at a distance from the carrier finger 95 sliding along an arcuate outer guiding 96, and thereby carrying out a rotation corresponding to the movement of the carrier fingers 95. The stable position of the packs results from the interaction of the carrier fingers 95 with the stop face 97 at a right angle of the carrier finger 95. A longitudinal side, specifically a side wall 22 or 23, adjoins the stop face 97.

As a result of the rotary movement of the turning member 93, after a rotation about 180°, the pack is moved into a position opposite of the starting position at the end of the pack track 48 (FIG. 17, right hand side). Here, the pack is transferred to the discharge conveyor 91 in an accurate position. For a smooth transfer, the sliding plate is provided with a special contour. A recess 98 is formed in the region of the discharge conveyor 91, specifically in a plane above an upper conveying strand 99 thereof. A receiving end of the discharge conveyor 91 extends in the region of the recess 98.

The pack conveyed on the sliding plate 92 reaches the region of the recess, and is specifically pushed over the edge 100 of the sliding plate 92 by the carrier finger 95. The pack 20 is thereby moved onto the conveying strand 99 of the discharge conveyor 91 by overcoming only a little difference in level.

Figure 18:
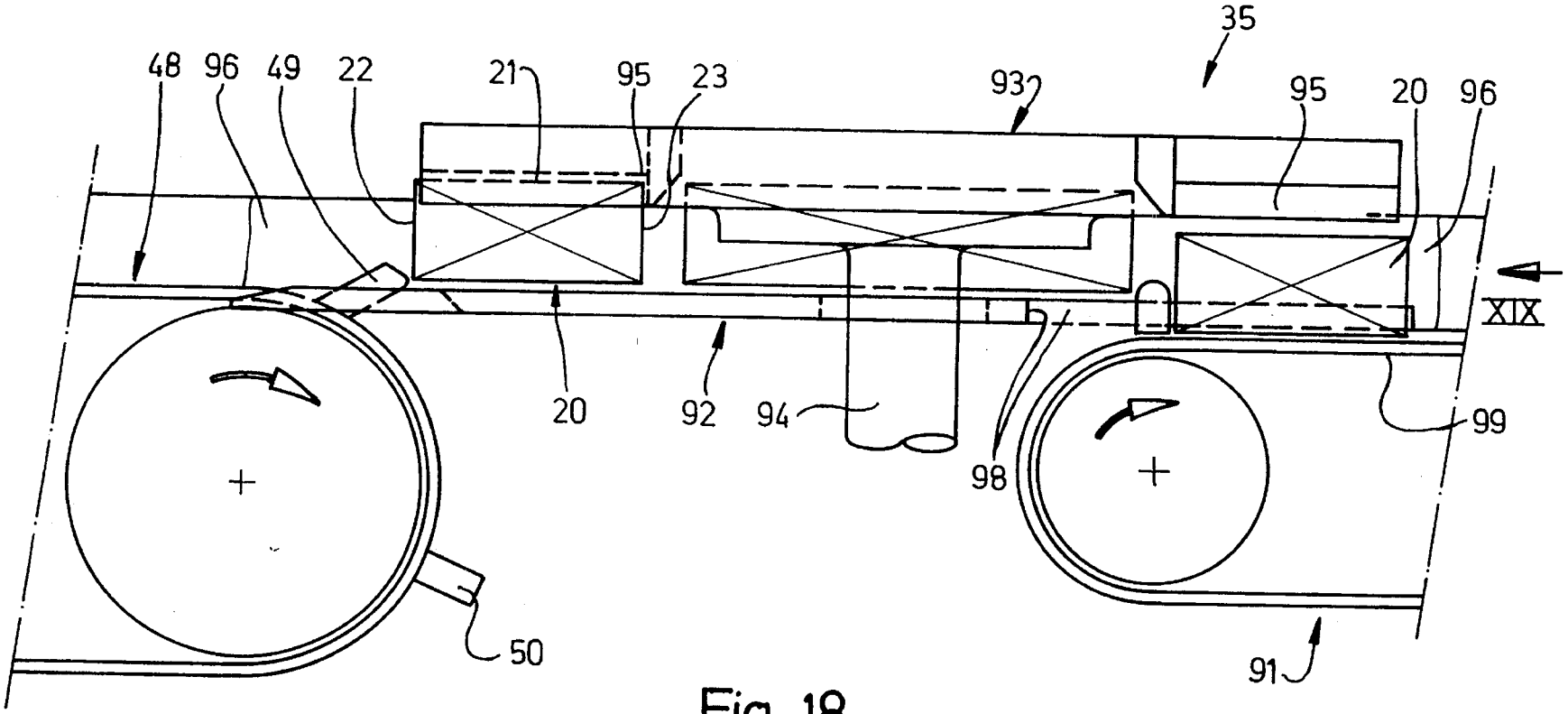
FIG. 18 shows the detail according to FIG. 17, in a side view.
Figure 19:
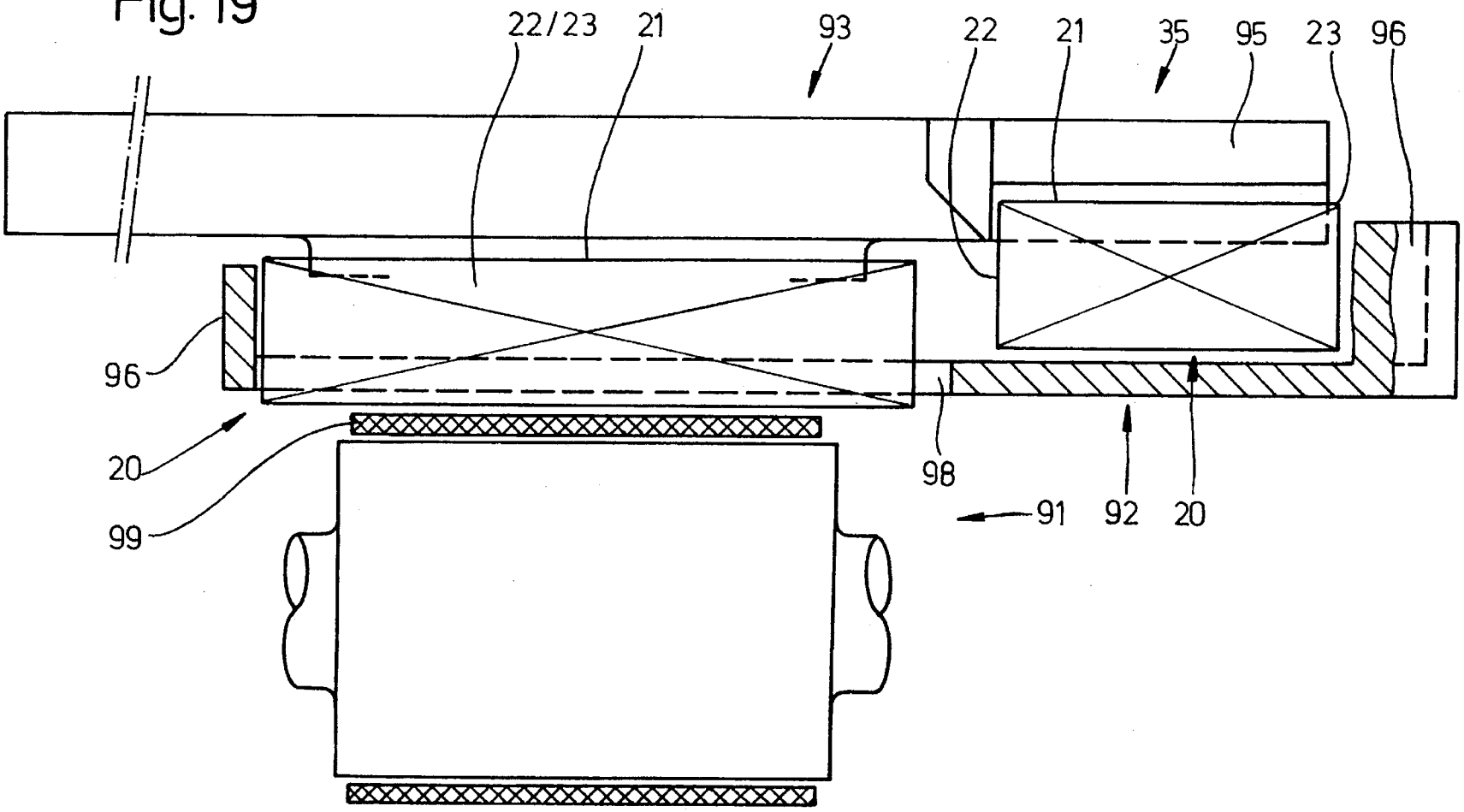
FIG. 19 shows a transverse view of the detail according to FIGS. 17 and 18 in the line of vision XIX of FIG. 18.

As emerges from FIG. 18, the arrangement i s such that the plate-shaped turning member 93 is arranged above the path of movement of the packs.

The turned packs can now be supplied to further processing, as for example to a bundle packer.

We claim:

1. An apparatus for the folding of a closing tab (25) of a pack (20), made from foldable material such as foil, paper or the like, against an end face of the pack, the closing tab (25) being connected to side walls (22, 23) of the pack (20) via lateral gussets (28), and the gussets (28) being foldable between the closing tab (25) and the end face when the closing tab is folded, said apparatus comprising a first folding member (61 ) and a second folding member (60) which are movable relative to one another in planes parallel to the end face and to one another;

wherein said first folding member has two triangular supporting legs (62, 63) with diverging folding edges (64), the supporting legs (62, 63) being formed stationary relative to one another;

wherein said second folding member (60) has two folding fingers (65, 66) which are arranged at a greater distance to the end face than the supporting legs (62, 63) of the first folding member (61), said folding fingers being movable in a plane parallel to the end face in a spreading movement;

means for moving said folding fingers apart in said spreading movement within the gussets (28) to fold the gussets by the folding fingers (65, 66) of the second folding member (60), in each case along one diagonal folding line (29), relative to the supporting legs (62, 63) of the first folding member (61) into a position between the supporting legs (62, 63) and the end face of the pack (20), such that the diagonal folding lines (29) contact the folding edges; and wherein, simultaneously, the closing tab (25) is foldable from a starting position, transverse to the end face of the pack, (20) into a position parallel to the pack.

2. The apparatus as claimed in claim 1, characterized in that the folding members (60, 61) form a part of the folding device (57), which can be lowered as a unit onto the pack (20) to be folded by a downward movement, specifically in the region of the closing tab (25), the relative movement of the folding members (60, 61) being controllable by the downward movement of the folding device (57).

3. The apparatus as claimed in claim 2, wherein a plurality of folding members (57) are arranged on a common conveyor, specifically on an endless device conveyor (58) and, for folding the folding tabs, can be lowered successively from above onto the packs, which are transported synchronously with the folding members (60, 61) by means of a pack conveyor (48).

4. The apparatus as claimed in claim 3, wherein the up and downward movement of the folding device (57) during the transport by the device conveyor (58) and/or the folding movement of the folding members (60, 61) and the folding tools thereof, specifically folding fingers (65, 66), can be controlled by a curve as a result of the transport of the folding devices (57) by the device conveyor (58).

5. The apparatus as claimed in claim 1, wherein the packs (20) can be transported on two parallel pack tracks (32) in two pack rows (36, 37) synchronously and aligned in pairs, each pack row (36, 37) being assigned separate folding devices (57) and these folding devices being preferably fixed on a common, centrally arranged device conveyor (58).

6. The apparatus as claimed in claim 5, wherein the device conveyor (58) assigned to the two pack rows (36, 37) is designed as an endless conveyor, especially as a conveyor belt, on which are fixed transversely directed crossbars (69), one folding device (57) being arranged on each laterally directed end of the crossbars (69) so as to be movable up and down.

7. The apparatus as claimed in claim 6, wherein guide and retaining members are laterally arranged on each crossbar (69) for the folding members (60, 61), especially upright guide bodies (80) with control tracks (81) for the folding fingers (65, 66), and upright guide rods (74, 75) for guiding and retaining upwardly and downwardly moveable supporting bodies (67) for the folding members (60, 61).

8. The apparatus as claimed in claim 7, wherein the crossbars (69) with laterally directed guide members, namely supporting rolls (73), are guided in grooves (70) of laterally stationary walls (71) for the accurate positioning of the folding devices (57) during the conveying movement.

9. The apparatus as claimed in claim 7, wherein the supporting bodies (67) for the folding members (60, 61) are guided with laterally directed control rolls (57) in a stationary guide groove (76), especially in the stationary wall (71), the control groove (76) being designed such that the supporting body (67) can be moved up and down relative to the crossbar (69) for carrying out the folding movement.

* * * * *